US005861798A

United States Patent [19]

Ankele, Jr.

[11] Patent Number: 5,861,798

[45] Date of Patent: Jan. 19, 1999

[54] ELECTRICAL NOISE GENERATION CIRCUITS FOR USE IN CONJUNCTION WITH AN ELECTRO-ACOUSTIC TRANSDUCER TO SIMULATE THE SOUND OF BURNING WOOD SOUNDS

[75] Inventor: Ernest T. Ankele, Jr., Richardson, Tex.

[73] Assignee: DEA Mfg., Plano, Tex.

[21] Appl. No.: 813,835

[22] Filed: Mar. 6, 1997

[51] Int. Cl.[6] ..... G08B 3/10

[52] U.S. Cl. ..... 340/384.3; 340/384.1; 340/384.7; 472/64; 126/500; 431/125

[58] Field of Search ..... 340/384.1, 384.3, 340/384.7; 472/64; 126/500; 431/125; 40/428; 381/98–100, 120–121; 446/397, 184, 297

[56] References Cited

U.S. PATENT DOCUMENTS

| | | | |
|---|---|---|---|
| 2,974,424 | 3/1961 | Roberts | 340/384.3 |
| 3,571,484 | 3/1971 | Hirose | 84/679 |
| 3,795,873 | 3/1974 | Fein et al. | 331/78 |
| 4,060,701 | 11/1977 | Epley | 73/599 |
| 4,481,852 | 11/1984 | Makuta et al. | 84/675 |
| 5,131,044 | 7/1992 | Brown, Sr. et al. | 381/61 |
| 5,594,802 | 1/1997 | Berghoff et al. | 381/61 |
| 5,635,898 | 6/1997 | Walters et al. | 340/394.7 |

*Primary Examiner*—Jeffery A. Hofsass
*Assistant Examiner*—Ashok Mannava
*Attorney, Agent, or Firm*—N. Rhys Merrett

[57] ABSTRACT

An electrical noise generation circuit for use in conjunction with an electro-acoustic transducer to simulate the sound of burning wood. A small loudspeaker enclosure accommodates a battery driven circuit in which a wideband electrical noise signal is produced by current flow through a zener diode. The noise signal is amplified by a frequency selective amplifier designed to have a high gain at a selected frequency in the audio frequency range, and rectified to produce unipolar signals which have randomly variable amplitudes and occur at random intervals. The unipolar signals are amplified by an amplifier having an adjustable input threshold bias. By adjustment of the bias level, output signals from the amplifier, and sounds produced by the loudspeaker, may be varied from intermittent individual pulses to rapid "bursts" of pulses. Operation of the circuit in proximity to an artificial log fire produces a surprisingly realistic audible simulation of wood burning sounds.

29 Claims, 3 Drawing Sheets

ELECTRICAL NOISE GENERATION CIRCUITS FOR USE IN CONJUNCTION WITH AN ELECTRO-ACOUSTIC TRANSDUCER TO SIMULATE THE SOUND OF BURNING WOOD SOUNDS

This invention relates to electrical noise generation circuits and in particular to electrical noise generation circuits for use in conjunction with an electro-acoustic transducer to simulate the sound of burning wood.

Gas and electrically operated artificial log fires have become increasingly popular and provide visually pleasing simulations of natural wood log burning fires. However, typically such fires do not produce the characteristic combustion sounds associated with natural wood logs as they burn, detracting from the realism and enjoyment of those fires.

One attempt to address this problem has used a recorded tape. However, limitations associated with the quality and duration of tape recordings made this an unsatisfactory solution.

The present invention provides a novel solution to the problem by using a solid state, wide band electrical noise source to generate a noise signal which is processed to generate randomly occurring, substantially unipolar output signals in a narrow audio-frequency band for driving an electro-acoustic transducer to cause it to emit sounds that can be customized to simulate the characteristic sounds of burning wood logs.

In one embodiment of the invention, a low-voltage battery driven circuit uses a small signal solid state diode as an electrical noise source. A wideband electrical noise signal is produced which is amplified by a frequency selective amplifier designed to have a high gain at a selected frequency in the audio frequency range. From the resultant narrow frequency band output signal (essentially a harmonic-free signal at the center frequency), substantially unipolar signals are derived which have randomly variable amplitude and occurring at random intervals and are used to drive an electro-acoustic transducer. The unipolar signals may be amplified by an amplifier having an adjustable input threshold bias, and since the intervals between and amplitudes of the unipolar signals change randomly, adjustment of the bias level has the effect that output signals from the amplifier may occur as intermittent individual pulses at one extreme, to rapid sequences of groups of pulses. Preferably, the circuit is accommodated inside the enclosure of a small loudspeaker. The resulting unit can have a very compact construction, permitting it to be located close to a fireplace but readily concealed from view. Operation of the circuit while an artificial log fire is in operation produces a surprisingly realistic audible simulation of sounds associated with burning natural wood logs. Advantageously, the intervals between and volume levels of the randomly emitted sounds can be varied by a user to produce the most pleasing sound effects. For example, the sounds may be adjusted such that they occur in randomly spaced, rapid sequences—or "bursts" of sounds, or as intermittent individual sounds, or in intermediate sequences. Instead of a battery supply, an a.c. converter could be used to generate the required d.c. supply voltage from an a.c. source.

The frequency of the selected frequency signal may suitably be within the range 2,000–4,000 Hz and be defined by a narrow pass band filter having a desired center frequency and steep response drop-off on either side of the center frequency, e.g. such that the 10 db points of the response characteristic are spaced apart by about 250–550 Hz. More particularly, a center frequency in the range 3,000–3,600 Hz defined by a notch filter having a response characteristic with 10 db points about 6–7% above and below the center frequency may be desirable. A double-T notch filter has been found particularly advantageous for defining the desired center frequency.

By way of example only, embodiments of the invention will be described in greater detail with reference to the accompanying drawings, in which.

Figure 1:
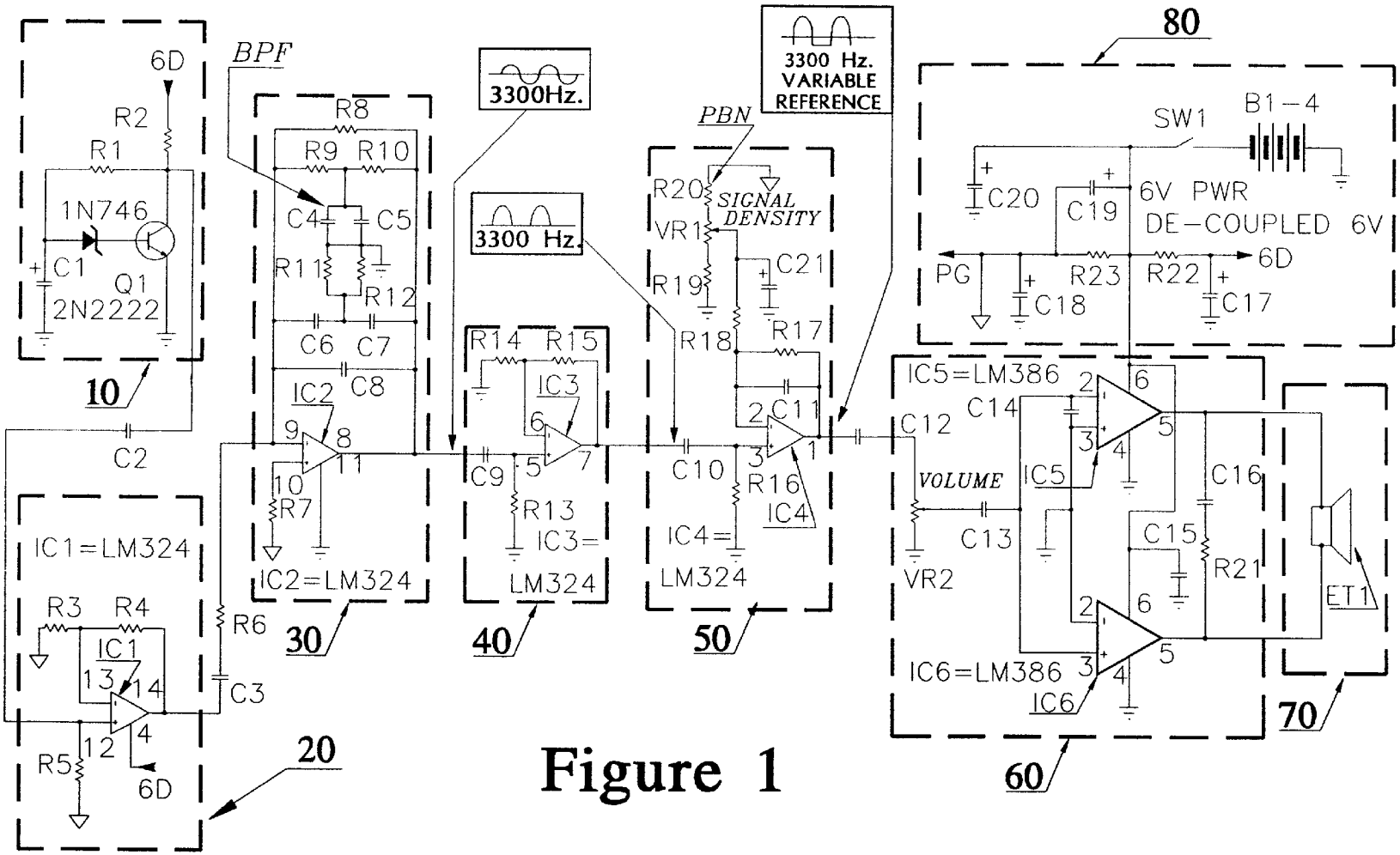
FIG. 1 is a circuit of a preferred embodiment of the invention.
Figure 2:
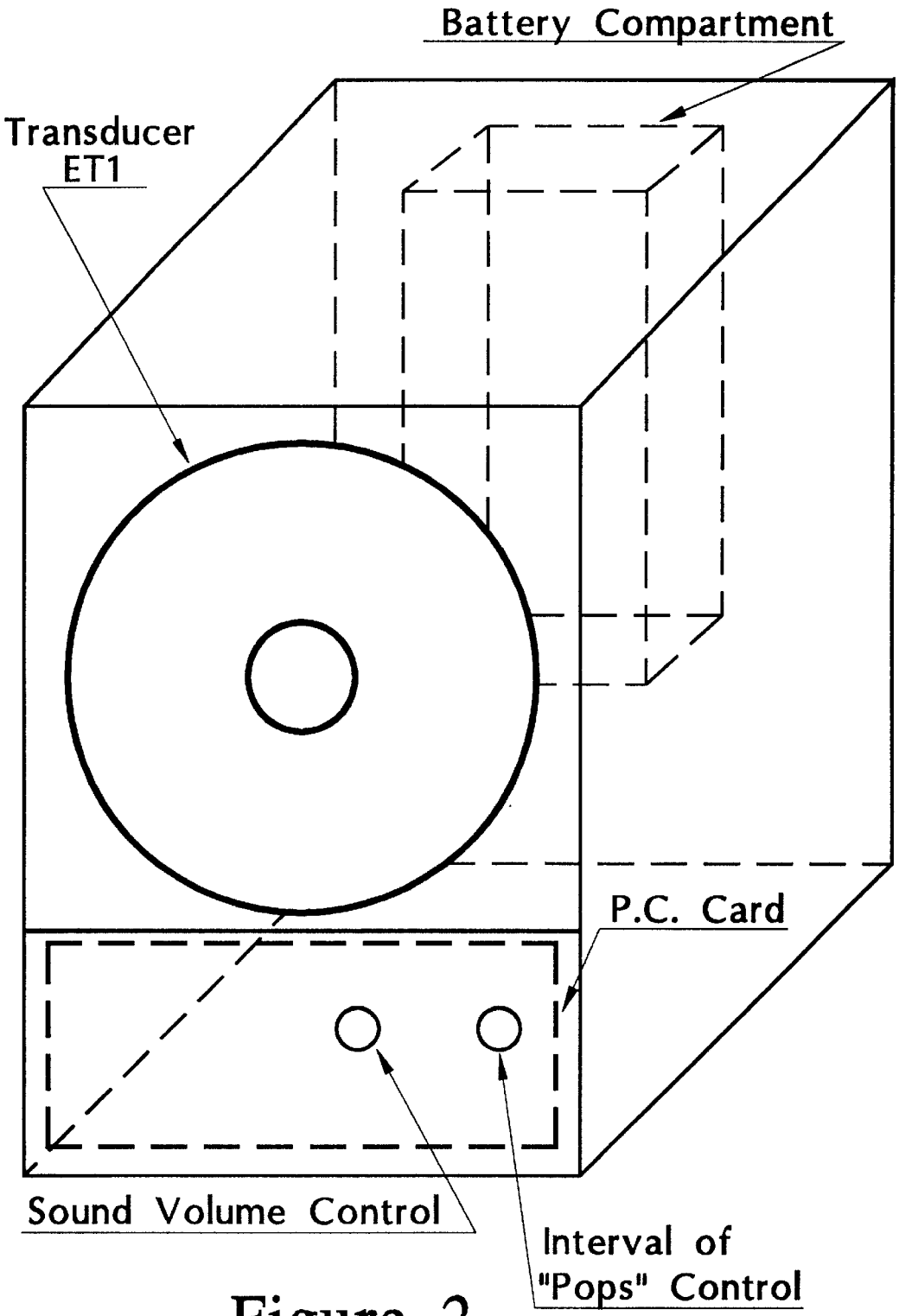
FIG. 2 is a view of a unit incorporating a circuit embodying the invention.

FIG. 1 is a circuit diagram of a solid-state miniaturized electrical noise generator circuit suitable for reproducing sounds that simulate burning wood, in particular burning wood logs. A specific application for the circuit is as an accessory for use in conjunction with a gas or electric artificial log fire in order to supplement the realistic visual simulation of burning wood logs with a comparably realistic audible simulation of the sounds—typically referred to as "pops" and "crackles"—arising as natural wood logs burn. The circuit, including its output electro-acoustic transducer may be accommodated in a compact enclosure (as depicted in FIG. 2) which may located close to a fireplace but easily concealed from view to enhance the perceived audible association of the emitted "crackles" and "pops" with the visual impression of "burning" artificial wood logs.

In FIG. 1, an input amplifier stage 10 comprises a wide-band, low current electrical noise generator input source, the output of which, after amplification by a wide-band preamplifier stage 20, is processed by a frequency selective amplifier 30, the output signal of which is centered in a narrow, predetermined band in the audio-frequency range. This narrow frequency band signal is then converted by the stage 40 to generate a substantially unipolar output signal which, after amplification by a signal conditioning stage 50 is input to a power amplifier 60 the output from which drives an electro-acoustic transducer 70. The circuit is powered by a low-voltage battery power source 80 and can be accommodated, together with a loudspeaker, in a small-dimensioned enclosure as shown in FIG. 2. Preferably, the enclosure is designed such that the emitted sound has minimal reverberation. In one embodiment of the invention, the circuitry is accommodated in an enclosure having external dimensions of about 7×5×4 inches permitting it to be located close to a fireplace but readily concealed from view.

As will be discussed, in a particular application of the circuit to generate randomly occurring sounds or bursts of sounds, the center frequency of the selective frequency amplifier stage 30 is chosen, in conjunction with the frequency response characteristics of the electro-acoustic transducer, such that the sounds emitted by the electro-acoustic transducer closely approximate the sounds that simulate the "popping" and "crackling" sounds of burning wood logs. Preferably, the signal conditioning amplifier stage includes a control by means of which the intervals between the unipolar signals output from that stage can be varied over a wide range (from rapid signal bursts to more widely spaced individual signals), and the power amplifier stage 60 incorporates a sound volume control. Together, these controls enable a user to readily adjust the characteristics of and the intervals between the generated "pops" and "crackles" sounds to achieve sounds that are most realistic and pleasing to the user. For example, the signal interval control may be adjustable to produce rapid bursts of sounds, or occasional individual sounds, or intermediately spaced sequences of sounds.

In more detail, the wide-band electrical noise generator 10 includes a small signal, solid state zener diode coupled to the base of a small signal amplifier transistor Q1. A resistor R1 limits current flow through the zener diode (typically to several tens of microamps) to the base of the transistor Q1, while a capacitor C1 provides an a.c. path to ground, so that substantially all noise generated by current flow through the zener diode occurs between the base of the transistor Q1 and ground. Current flow through the zener diode generates random electrical noise components over a wide frequency band so that the output signal at the collector of the transistor Q1 is an amplified wide-band noise signal having positive and negative excursions. Suitably, the zener diode may be a 0.5 watt rated 1N746 device. A zener diode has been found to be particularly well suited and is preferred, although other low current zener diodes (and in principle other types of diode) that generate a significant noise signal, preferably with a small current flow, may be utilized.

This a.c. output noise signal from the transistor Q1 is amplified by the preamplifier stage 20 which comprises a non-inverting wide-band, high signal gain integrated circuit (IC) amplifier IC1, configured as an operational amplifier stage. The amplifier IC1 has a 6 volt power supply 6 D and both its inverting and non-inverting inputs are coupled to a 3 volt pseudo-ground bias level PG by respective bias resistors R3 and R5. The output of the amplifier ICI is coupled to the inverting input of an IC amplifier IC2 comprising the frequency selective amplifier stage 30, and the non-inverting input is coupled to the pseudo-ground bias level PG by a resistor R7. A negative feedback loop between the output and the inverting input of the amplifier IC2 includes a filter network BPF having a narrow pass band centered on a desired frequency in the audio-frequency range, suitably within the range 2 to 4 kHz. The center frequency output signal from the amplifier IC2 is substantially harmonic free. The 3 v bias PG supplied to the amplifiers IC1 and IC2 sets the operational parameters for those amplifiers to operate with equal positive and negative signal excursions.

As shown, a twin T-notch filter design is employed for the filter PBF, although other narrow pass band filter designs could be used (for example, customized combinations of high-pass and low-pass filters could be designed but likely would require more amplification and thus more power consumption). Use of such a notch filter in this manner results in a high signal gain at the center frequency of the pass band of the filter which exhibits steep drop off in gain on either side of the center frequency.

Figure 3:
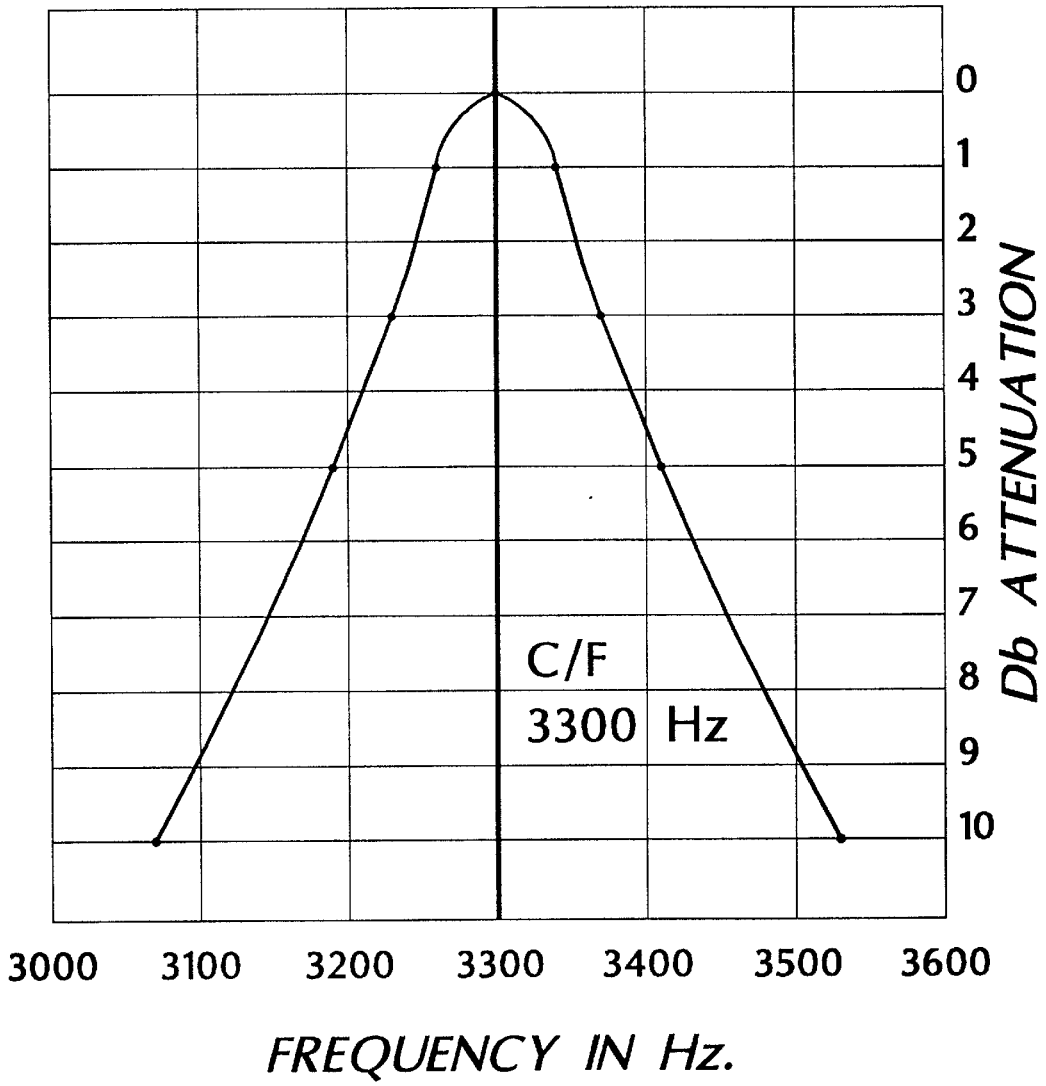
FIG. 3 shows an example of a suitable frequency response characteristic of a filter employed in the circuit of FIG. 1.

In a preferred implementation, the resistor and capacitor components of the filter PBF are selected to achieve a center frequency of approximately 3,300 Hz which has been demonstrated to produce particularly realistic simulations of the "crackle" and "pop" sounds typically produced by natural wood burning fires. However, in principle the center frequency could be located anywhere in the approximate 2,000 Hz to 4,000 Hz range of the audio frequency band. FIG. 3 shows a particularly effective pass band characteristic for the filter PBF such that it is centered on 3,300 Hz with a well defined, narrow (steep sided) peak, and 10 db response points at about 3,075 Hz and 3,575 Hz, i.e. about 6–7% below and above the center frequency. The output signal from the amplifier stage 30 is a randomly occurring simulated sine wave signal at a frequency of approximately 3,300 Hz, having both positive and negative excursions.

The output of the amplifier IC2 is coupled to the non-inverting input of a grounded bias integrated circuit differential amplifier IC3 of the signal rectifier/amplifier stage 40. The amplifier IC3 is configured to provide input signal rectification by clipping negative excursions of the input signal and amplifying the positive excursions to offset the signal power loss due to negative excursion clipping, resulting in an output signal comprising a sequence of approximately 3,300 Hz unipolar sinusoidal pulses. The output of the rectifier/amplifier IC3 is coupled to the non-inverting input of a differential IC amplifier IC4 included in the signal conditioning amplifier stage 50. The amplifier IC4 is configured as a grounded bias amplifier and also incorporates a variable bias feedback network PBN including a variable potentiometer chain RV connected between the pseudo-ground bias level PG and ground. The variable potentiometer tap is connected to the inverting input of the amplifier IC4 so that a variable positive bias can be applied to that input. By adjustment of the potentiometer tap, threshold level of the input signals to the amplifier IC4 can be varied which adjusts the interval between output pulses or groups of output pulses from the amplifier 40 to generate intermittently occurring individual pulses to rapid successions—or bursts—of pulse sequences.

The output signal sequence from the amplifier IC4 is coupled to the inverting and non-inverting inputs, respectively, of a pair of differential low voltage, IC power amplifiers IC5 and IC6 connected together as a bridge amplifier. The amplifier stage 60 provides power amplification of the input signal, the level of which can be adjusted by a variable resistor VR2 in the signal path from the amplifier IC4 to the signal inputs of the amplifiers IC5 and IC6. The bridge configuration of the power amplifier 60 doubles the output signal amplitude compared to that of a single amplifier, as well a s providing power gain. The outputs of the amplifiers IC5 and IC6 are connected to the respective ends of the coil of a small diameter, suitably 3 to 5 inches diameter, moving coil loudspeaker ET1. The center frequency of the band pass filter PBF preferably should lie in a relatively flat region of the frequency response characteristic of the loudspeaker, and adequately displaced from the response drop off frequencies.

The circuit shown in FIG. 1 conveniently can be powered from a d.c. battery pack PWR which provides a decoupled 6 volt supply for all the amplifiers IC1–IC6 in the circuit and a 3 volt pseudo-ground level PG for biasing purposes. A high capacitance capacitor C20 provides a very low a.c. impedance to ground for stabilizing the operation of the power amplifiers, IC5 and IC6. Instead of a d.c. battery pack, the circuit d.c. power supply could be derived from an a.c. source using an a.c. converter.

The output from the transducer ET1 comprises randomly occurring sequences of audible sounds having variable sound levels that emulate "pops" and "crackles" characteristically associated with the sound of burning wood logs. The intervals between the sounds or groups of sounds in the sequence can be varied by adjustment of the potentiometer VR1 while the sound volume can be varied by adjustment of the potentiometer VR2.

The IC amplifiers IC1–IC4 conveniently may be implemented using a single LM324 quad amplifier having a common power supply terminal connected to power supply 6 D. The power amplifiers IC5 and IC6 conveniently may be implemented using LM386 low voltage, audio power amplifiers.

As depicted in FIG. 2, the random noise amplifier circuit described with reference to FIG. 1 can be implemented on a printed circuit card PC located in an enclosure ENC for the loudspeaker ET1. The battery power pack is accommodated in a recess in the rear wall of the enclosure while the loudspeaker is mounted on the interior of the front wall. (The cone opening of the loudspeaker is shown without a decorative cover in place.) The enclosure preferably should dampen sound reverberation and not enhance bass response. in one construction of the unit, the enclosure dimensions are about 7×5×4 inches, permitting the complete unit to be located close to a gas or electrically powered artificial wood log fireplace. By concealing the unit from normal view, the sounds produced by the unit appear to emanate from the "burning" logs thereby producing a very realistic visual and audible perception a burning natural logs.

I claim:

1. A circuit for generating an audible simulation of burning wood, comprising:

a wideband electrical noise source coupled to an input of an amplification and rectification circuit having a narrow audio-frequency pass band output;

an electro-acoustic transducer having a drive input coupled to an out put of the amplification and rectification circuit to receive from said output substantially unipolar output signals in said pass band.

2. A circuit according to claim 1, wherein the electrical noise source comprises a small signal solid state diode.

3. A circuit according to claim 2, wherein the diode is a zener diode.

4. A circuit according to claim 1, wherein the frequency selective amplifier comprises a negative feedback loop including a narrow band-pass filter.

5. A circuit according to claim 4, wherein the filter has a pass band of about 250–550 Hz and a peak frequency response approximately centered in the pass band.

6. A circuit according to claim 5, wherein the filter has a center frequency in the range 2,000 to 4,000 Hz.

7. A circuit according to claim 5, wherein the filter is a T-notch filter.

8. A circuit according to claim 1, including a variable input bias level amplifier circuit coupled to the output of said rectifier circuit.

9. A circuit according to claim 1, including a power amplifier coupling the rectifier circuit to the drive input of the electro-acoustic transducer.

10. A circuit according to claim 1, including a low voltage d.c. power source connected to power said circuit.

11. A circuit for simulating the sound of burning wood, suitable for use as an accessory to an artificial wood log fire, comprising:

a wide band electrical noise source coupled to an input of amplifier circuitry for producing amplified electrical noise output signals within a selected, narrow audio-frequency band;

circuitry for deriving a stream of randomly occurring amplified, predominantly unipolar signals from said noise output signals;

and electro-acoustic transducer means for receiving said stream of amplified, predominantly unipolar signals as a drive input and producing randomly occurring audible output sounds characteristic of burning wood.

12. A circuit according to claim 11, wherein said electro-acoustic transducer is accommodated by a reverberation damping housing.

13. A circuit according to claim 11, wherein said selected audio-frequency pass band is defined by filter means for defining a center pass frequency and having 10 db response points about 6–7% on either side of said center pass frequency.

14. A circuit according to claim 13, wherein said filter means comprises a notch filter having a center frequency in the range 3,000 to 3,600 Hz.

15. A circuit according to claim 11, including bias level circuit means for adjusting the intervals between unipolar signals or groups of signals in said stream of unipolar signals.

16. A method of generating audible sounds simulating burning wood log sounds, comprising the steps of:

amplifying low level electrical noise signals to produce a stream of randomly occurring noise signals;

generating randomly occurring substantially unipolar signal components of said stream of noise signals within a selected, narrow audio-frequency band; and using said substantially unipolar signal components to drive an electro-acoustic transducer to produce a randomly occurring sequence of sounds approximating sounds of burning wood logs.

17. A method according to claim 16, wherein said electrical noise signals are wide band electrical noise signals.

18. A method according to claim 17, wherein said wide band electrical noise signals are produced by low level current flow through a solid state resistive element.

19. A method according to claim 18, wherein said solid state resistive element is a unidirectional current flow device.

20. A method according to claim 16, wherein said stream of noise signals within a selected, narrow audio-frequency band is produced by narrow band-pass frequency filtering said randomly occurring stream of noise signals.

21. A method according to claim 20, wherein said narrow band-pass filtering is characterized by a pass band frequency response having a center frequency in the range 2,000 to 4,000 Hz and having 10 db response points about 6–7% above and below said center frequency.

22. A method according to claim 16, wherein said stream of unipolar signals can be varied as to amplitude levels and intervals between signals.

23. Apparatus for simulating sounds produced by burning natural wood logs, suitable for use as an accessory to an artificial wood log fireplace, including a random noise generating circuit comprising:

a wide band, small signal amplifier having an input circuit including a wide band solid state electrical noise source;

a frequency selective amplifier coupled to a signal output of said small signal amplifier, said frequency selective amplifier including a negative feedback loop determining a narrow frequency pass band of output signals from said frequency selective amplifier, said narrow frequency band centered on a frequency in the range of about 2,000 Hz to 4,000 Hz and defined by a frequency response characteristic having 10 db points spaced apart by about 250 to 550 Hz;

a signal rectifier circuit having an input coupled to a signal output of said frequency selective amplifier and an output coupled to an input of a power amplifier; and an electro-acoustic transducer having a drive input coupled to an output of said power amplifier.

24. Apparatus according to claim 23, wherein said signal rectifier circuit includes an amplifier stage having an input coupled to a variable threshold bias level circuit.

25. Apparatus according to claim 23, including a low voltage d.c. source coupled to power said random noise generating circuit.

26. Apparatus according to claim 22, including a reverberation damping enclosure housing said random noise generating circuit and said electro-acoustic transducer.

27. Apparatus for simulating sounds produced by burning natural wood logs, suitable for use as an accessory to an artificial wood log fireplace, including a random noise generating circuit comprising:

a) a wide band, small signal input amplifier having an input circuit including a zener diode providing a wide band solid state electrical noise source;

b) a frequency selective amplifier coupled to a signal output of said small signal amplifier, said frequency selective amplifier including a negative feedback loop including a band pass filter determining a narrow frequency pass band of output signals from said frequency selective amplifier, said narrow frequency band centered on a frequency in the range of about 2,000 Hz to 4,000 Hz;

c) a signal rectifier and amplification circuit having an input coupled to a signal output of said frequency selective amplifier, and an output coupled to supply randomly occurring, substantially unipolar signals to an input of a power amplifier;

d) said input amplifier, frequency selective amplifier, signal rectifier and amplification circuit, and power amplifier interconnected with each other on a printed circuit card; and a low voltage d.c. power source for powering said random noise generating circuit; and an electro-acoustic transducer having a drive input coupled to an output of said power amplifier, said electro-acoustic transducer, printed circuit card and power source all contained in a common enclosure to provide a self-contained unit.

28. Apparatus according to claim 27, wherein said frequency band is a narrow band defined by a filter having center frequency in the approximate range 3,000–3,600 Hz. and a frequency response characteristic having 10 db points at frequencies about 6–7% above and below said center frequency.

29. Apparatus according to claim 28, wherein said narrow frequency band is defined by a twin T-notch filter.

* * * * *